US007284475B2

(12) United States Patent
Paval

(10) Patent No.: US 7,284,475 B2
(45) Date of Patent: Oct. 23, 2007

(54) PNEUMATIC RECIPROCATING MOTOR

(75) Inventor: Dan Paval, Calgary (CA)

(73) Assignee: Envirodrive Inc., Red Deer (CA)

( * ) Notice: Subject to any disclaimer, the term of this patent is extended or adjusted under 35 U.S.C. 154(b) by 68 days.

(21) Appl. No.: 11/313,888

(22) Filed: Dec. 22, 2005

(65) Prior Publication Data

US 2006/0144222 A1 Jul. 6, 2006

(30) Foreign Application Priority Data

Dec. 30, 2004 (CA) ..... 2,491,298

(51) Int. Cl.
*F04B 9/133* (2006.01)
*F04B 23/08* (2006.01)

(52) U.S. Cl. ..... 92/182; 91/303; 417/403

(58) Field of Classification Search ..... 91/166, 91/281, 299, 303, 320, 340, 350, 354, 422; 92/181 P, 182, 183, 184; 417/398, 399, 417/403

See application file for complete search history.

(56) References Cited

U.S. PATENT DOCUMENTS 76,002 A * 3/1868 Thomas et al. ..... 91/286
841,527 A * 1/1907 Imler ..... 92/181 R
3,465,686 A * 9/1969 Nugier ..... 417/403
3,811,795 A * 5/1974 Olsen ..... 91/306
6,336,389 B1 1/2002 English et al.
6,694,858 B2 * 2/2004 Grimes ..... 91/350

FOREIGN PATENT DOCUMENTS

GB 2307013 A * 5/1997

* cited by examiner

*Primary Examiner*—Thomas E. Lazo
(74) *Attorney, Agent, or Firm*—Donald V. Tomkins

(57) ABSTRACT

A gas-actuated reciprocal drive apparatus has a double-acting piston in a pneumatic cylinder having a chamber at each end. Gas from an area of higher pressure in a compressed gas system flows into a first chamber, while the second chamber is in fluid communication with an area of lower pressure in the gas system. The piston moves toward the second chamber, purging gas therein back to the lower-pressure area in the gas system, without any venting to the atmosphere. A four-way gas valve reverses the piston motion after each stroke, by reversing the chambers' gas connections. The piston has a pair of circumferential seals, plus a differential shuttle valve that allows gas from the lower-pressure chamber to enter the annular space between the seals, such that the pressure differential across the seals always equals the pressure differential between the two chambers, regardless of the actual pressures in the chambers, thus reducing friction forces on the piston seals, increasing the power output of the apparatus, and extending the service life of the seals.

20 Claims, 13 Drawing Sheets

FIG. 4B
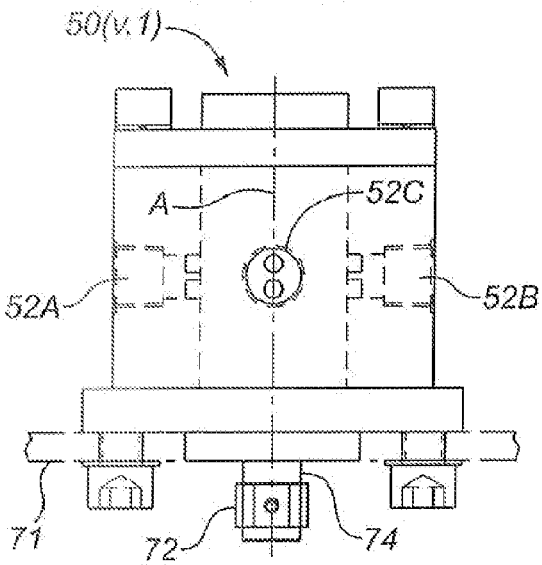
FIG. 4D
(SEC. C-C)
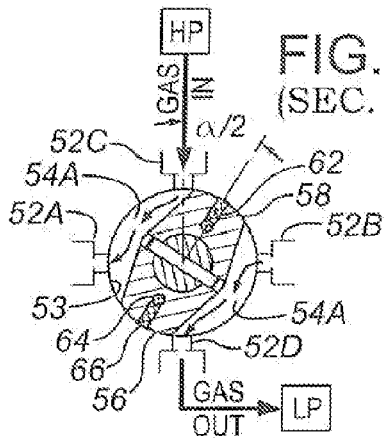
FIG. 4E
(SEC. C-C)
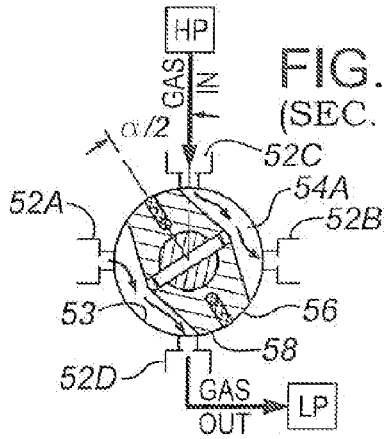
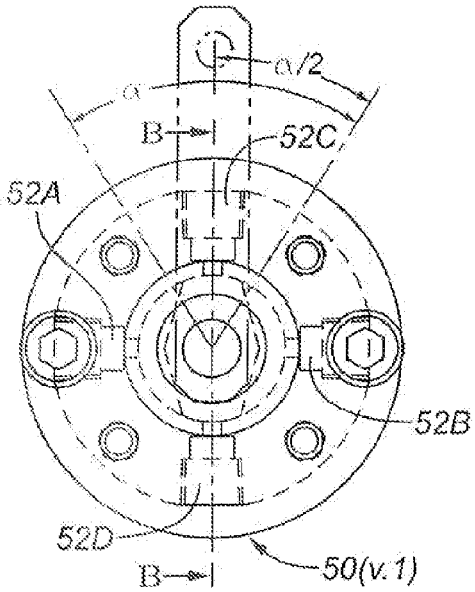
FIG. 4A
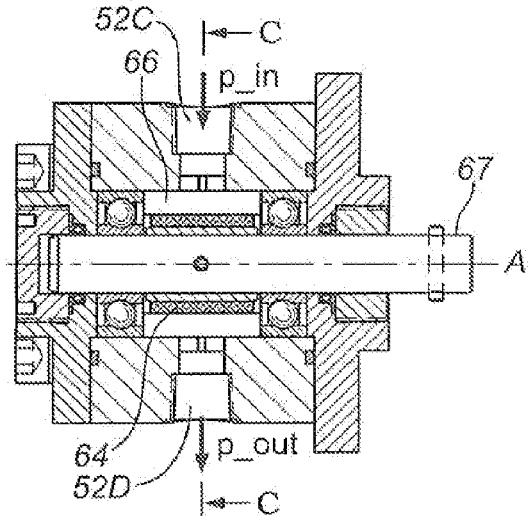
FIG. 4C
(SEC. B-B)

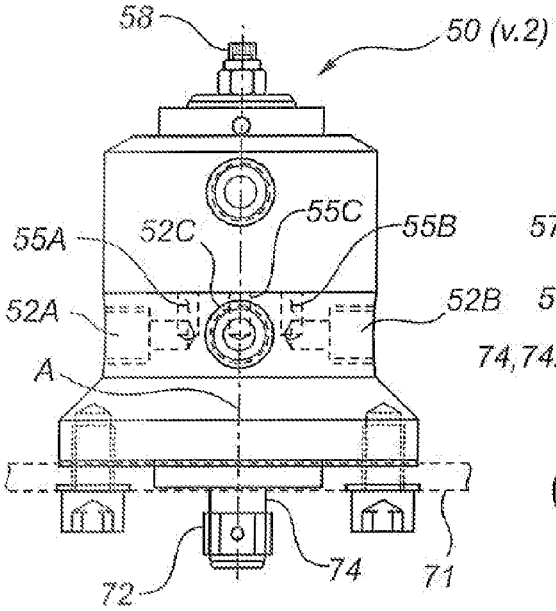
FIG. 5B
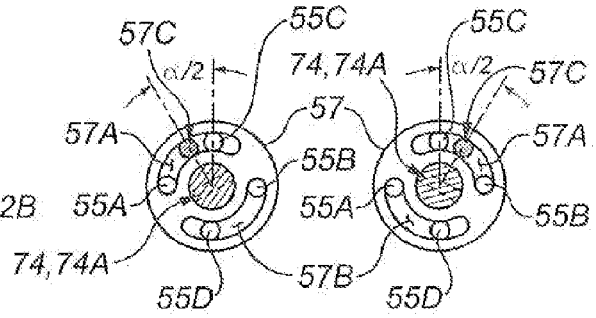
FIG. 5D
(Sec. E-E)
FIG. 5E
(Sec. E-E)
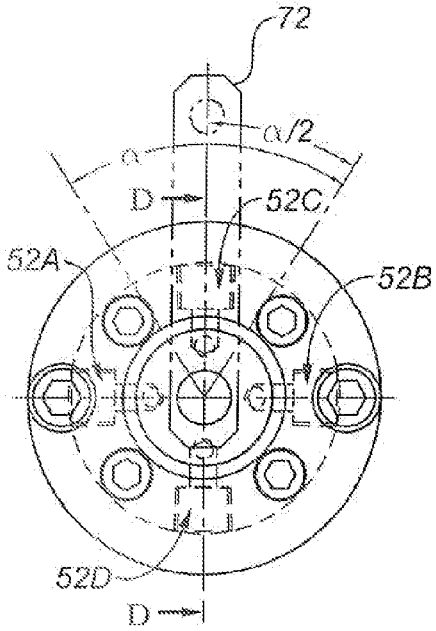
FIG. 5A
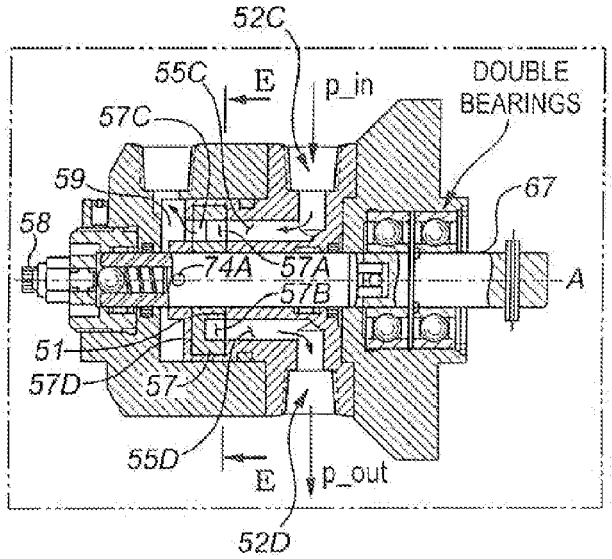
FIG. 5C
(Sec. D-D)

(Sec. G-G)

(Sec. G-G)

(Sec. D-D)

(Sec. A-A)

PNEUMATIC RECIPROCATING MOTOR

FIELD OF THE INVENTION

The present invention relates to reciprocating drive apparatus actuated by a pressurized gas, and in particular to reciprocating drive apparatus that is actuated by a pressurized gas without exhausting the actuating gas to the atmosphere.

BACKGROUND OF THE INVENTION

In natural gas production facilities, it is often necessary or desirable to periodically or continuously inject liquids into a high pressure gas pipeline. One example is the injection of methanol to prevent any water present in the natural gas from freezing. Such liquids are injected by means of pumps which overcome the pressure of the compressed gas to force the liquid into the pipeline. These injection pumps are often powered by pneumatic devices, particularly in remote locations. In some situations, the compressed gas flowing in the pipeline is used to drive the pump, but usually only after it has been regulated down to a pressure suitable for the pneumatic device (often around 10 pounds per square inch). The exhaust gas from the pneumatic device comes out of the device at a lower pressure than the gas in the pipeline, so it cannot be reinjected into the pipeline unless it is first compressed. Therefore, the exhaust gas is usually vented to atmosphere. In some situations a gas such as propane is brought to the site, stored in a pressure vessel, and used to drive a pneumatic device. This gas is also vented to atmosphere from the pneumatic device.

This venting of the exhaust gas to the atmosphere is a problem, firstly because it is a waste of valuable gas, secondly because it causes environmental contamination. In the case of sour gas wells (i.e., wells producing natural gas with high hydrogen sulphide content), it is generally prohibited, on environmental and health grounds, to use drive apparatus actuated by well gas where the exhaust gas is vented to atmosphere. Accordingly, there is a need for drive apparatus for driving injection pumps and other equipment associated with natural gas wells, using raw gas from the well to actuate the apparatus, but without venting the actuating gas to the atmosphere.

U.S. Pat. No. 6,336,389, issued Jan. 8, 2002 to English et al., discloses one example of prior art apparatus directed to this objective, mobilizing the kinetic energy inherent in the differential pressure between areas of higher and lower pressure in a pressurized gas system such as a pipeline. The English apparatus uses a single-acting piston that reciprocates within an open-ended cylinder inside a pressure vessel, where the interior of the pressure vessel is in fluid communication with the area of lower pressure, such that the bottom end of the piston is always exposed to the lower pressure. A switching valve allows gas from the area of higher pressure to flow into the chamber at the closed end cylinder, thus inducing a pressure differential between the two ends of the piston, causing the piston to move in a downward or power stroke. Linkage mechanism is provided for transferring the energy from the power stroke to an oscillatingly rotating output shaft, which is then connected to an injection pump or other type of equipment to be driven.

At or near the end of the downward stroke, the switching valve opens the piston chamber to the interior of the pressure vessel and closes off flow or higher pressure gas into the chamber, thus equalizing the pressure on each end of the piston. Biasing means such as a spring then moves the piston back to the top of the piston, thus exhausting the gas in the piston chamber into the pressure vessel and, effectively, into the area of lower pressure within the pressurized gas system. At or near the end of this exhaust stroke, the switching valve closes off the piston chamber from the interior of the pressure vessel and opens the chamber once again to the flow of gas from the area of higher pressure, thus readying the apparatus for the next downward power stroke.

The English apparatus effectively provides means for gas-driven actuation of injection pumps or other equipment without venting of the actuating gas. The English apparatus can operate with pressure differentials as low as 25 psi, so the internal mechanisms of the apparatus are not exposed to high pressures, even though the pressure in the gas system that drives it may be 1,000 psi or higher. However, the output of this apparatus is limited to an oscillating rotary drive. Commonly-used chemical injection pumps, on the other hand, require a reciprocating drive. Accordingly, the use of the English apparatus to drive a reciprocating-drive pump entails some kind of motion-converting mechanism to convert the oscillating rotary output motion to a reciprocating motion. This adds to the overall cost and mechanical complexity of the apparatus used to drive the pump, and reduces the overall mechanical efficiency of the apparatus.

Since the English apparatus uses a single-acting piston, and thus produces power only on half of the piston strokes, its mechanical efficiency is less than would be the case for apparatus using a double-acting piston and producing power on each piston stroke. An additional drawback of the English apparatus is that the spring or other biasing means (for returning the piston to the top of the cylinder after each power stroke) must be compressed during each power stroke, thus consuming part of the energy inherent in the pressure differential and thereby reducing the power output of the apparatus.

U.S. Pat. No. 6,694,858, issued Feb. 24, 2004 to Grimes, discloses a gas-driven reciprocating drive unit that uses a double-acting piston within a closed cylinder, in association with a pressurized gas system such as a gas pipeline. A switching valve directs gas from area of higher and lower pressure to opposite sides of the piston. The pressure differential between the two ends of the double-acting piston causes the piston to move toward a first end of the cylinder, simultaneously exhausting the gas in the first end of the cylinder back into the pressurized gas system. A drive link connected to the piston is used to transfer the power generated by the movement of the piston to a pump or other piece of equipment. At or near the end of each piston stroke, the switching valve reverses the connections to the areas of higher and lower pressure in the pressurized gas system, thus inducing a pressure differential that causes the piston to move in the direction opposite to the previous stroke and thereby exhausting the gas in the second end of the cylinder back into the pressurized gas system.

One of the significant drawbacks and disadvantages of the Grimes apparatus is the susceptibility of the piston seals to wear and deterioration. In order to maintain a pressure differential between the ends of the cylinder, the double-acting piston requires circumferential seals of some suitable type to prevent the flow of gas between the two ends of the cylinder via the annular space between the piston and cylinder. The ambient pressure within the annular space between the seals is constant, and typically atmospheric (i.e., approximately 15 psi). In contrast, the gas pressure within each end of the cylinder may be 1,000 psi or greater. As a result (and unlike the piston seals in the English apparatus), both of the seals in the Grimes apparatus are continuously working against a very large pressure differential, notwithstanding the fact that the piston itself is exposed to only a small pressure differential. The high differential pressure acting across the seals induces proportionately higher friction forces at the cylinder interface. These friction forces must be overcome in order for the piston move, and the power required to do this directly reduces the available power output from the apparatus. If the friction forces become too high, the piston may be susceptible to seizing or stalling ("stiction"). In addition, the high friction forces promote wear on the seals, thus making seal replacement necessary more often than would be the case in absence of high differential pressures across the seals.

For the foregoing reasons, there remains a need for reciprocating drive apparatus that not only may be actuated by raw pressurized gas from a natural gas well without venting the actuating gas to the atmosphere, but that also provides a direct reciprocating final drive output without need for motion-converting mechanisms. There is a further need for reciprocating pneumatic drive apparatus in which the seals between the piston and cylinder of the apparatus are exposed to a low pressure differential, therefore being less susceptible friction-induced power output losses, and less susceptible to wear and deterioration, than in prior art pneumatic drive apparatus. The present invention is directed to these needs.

BRIEF SUMMARY OF THE INVENTION

In general terms, the present invention is a closed-loop, gas-actuated reciprocal drive apparatus that utilizes the potential energy inherent in the pressure differential between an area of higher pressure and an area of lower pressure in a compressed gas system, such as a natural gas pipe line, to enable the pressurized gas to actuate the apparatus while exhausting the actuating gas back into the compressed gas system, without exhausting the actuating gas to atmosphere. The apparatus converts the potential energy from the pressure differential into linear reciprocating motion, using a double-acting, double-rod piston moving within a pneumatic cylinder. The cylinder defines a pneumatic chamber at each end, with the linear length of the chamber varying as the piston moves within the cylinder. Operation of the apparatus is initiated by allowing gas from an area of higher pressure to flow into one chamber, while the other chamber is in fluid communication with an area of lower pressure. This induces a pressure differential that causes the piston to move toward the lower-pressure chamber, and at the same time purging the gas from that chamber. A four-way, two-position gas valve is used in conjunction with an angular incremental switch mechanism to reverse the motion of the piston at the end of each stroke, by reversing the connections of the chambers to the areas of higher and lower pressure in the gas system.

Each end of the piston has a piston rod reciprocatingly extending through a corresponding end the cylinder, for providing linear drive force to a plunger pump or piston pump (or other devices). The apparatus is thus capable of driving two pumps at the same time. Moreover, the apparatus is capable of doing so in conditions where the differential between the areas of higher and lower pressure is as low as 10 psi.

The gas used to actuate the apparatus is always returned to the pressurized gas system from which it was supplied. Accordingly, the apparatus is a fully-closed system that vents no gas to atmosphere, and therefore is readily usable in conjunction with sour gas wells.

The piston has a circumferential piston seal near each end, and further incorporates a differential shuttle valve that allows gas from the low-pressure chamber of the cylinder to enter the annular space between the seals. The pressure differential across the seals is thus equal to the differential between the two chambers of the cylinder, regardless of the magnitude of the gas pressures in the chambers. As a result, the friction forces between the piston seals and the cylinder walls remain substantially constant, and of substantially lesser magnitude than in prior art apparatus having double-acting cylinders, thereby increasing the power output of the apparatus and extending the service life of the seals.

Accordingly, in one aspect the present invention is a reciprocating pneumatic drive apparatus for use in association with a compressed gas system having an area of higher pressure and an area of lower pressure, said apparatus comprising:

(a) a cylinder having a cylindrical sidewall extending between a pair of cylinder heads, each of which has a piston rod opening;

(b) a piston having first and second piston faces plus first and second piston rods, each projecting from a corresponding piston face, said piston being reciprocatingly slidable within the cylinder, with each piston rod being sealingly slidable through the piston rod opening of a corresponding one of the cylinder heads, said piston demarcating first and second variable-length cylinder chambers, one at each end of the cylinder;

(c) a pair of spaced-apart piston seals disposed circumferentially around the piston, for sealing between the piston and the sidewall, said piston seals defining the ends of an annular space;

(d) valve means operable between a first position in which the first and second cylinder chambers are in fluid communication with the areas of higher and lower pressure respectively, and a second position in which the first and second cylinder chambers are in fluid communication with the areas of lower and higher pressure respectively, so as to induce reciprocating movement of the piston within the cylinder; and (e) switch means operable to switch the position of the gas flow valve at or near the end of each stroke of the piston;

wherein:

(f) the piston has a transverse passage extending between the piston faces, and a radial passage extending between the transverse passage and the annular space; and (g) the apparatus further comprises shuttle valve means retainingly disposed within the transverse passage, for enabling gas from whichever cylinder chamber is under lower pressure to flow through the transverse and radial passages into the annular space, while preventing the flow of gas from the cylinder chamber under higher pressure into the transverse passage.

In a second aspect, the invention is a reciprocating pneumatic drive apparatus for use in association with a compressed gas system having an area of higher pressure and an area of lower pressure, said apparatus comprising:

(a) a cylinder having a cylindrical sidewall and first and second cylinder heads, each cylinder head having a piston rod opening;

(b) a piston reciprocatingly disposed within the cylinder, said piston having first and second piston faces, and having a circumferential side face extending between said first and second piston faces;

(c) a first cylinder chamber defined by said sidewall, first cylinder head, and first piston face, the size of said first cylinder chamber varying according to the position of the piston within the cylinder;

(d) a second cylinder chamber defined by said sidewall, second cylinder head, and second piston face;

(e) a first piston rod rigidly fixed to the piston and extending from the first piston face, and being reciprocatingly and sealingly movable through the piston rod opening of the first cylinder head;

(f) a second piston rod rigidly fixed to the piston and extending from the second piston face, and being reciprocatingly and sealingly movable through the piston rod opening of the second cylinder head;

(g) first piston sealing means, for sealing between the sidewall and the side face of the piston, adjacent to the first piston face;

(h) second piston sealing means, for sealing between the sidewall and the side face of the piston, adjacent to the second piston face;

(i) first cylinder head port, in fluid communication with the first cylinder chamber;

(j) second cylinder head port, in fluid communication with the second cylinder chamber;

(k) a gas flow control valve alternatingly operable between a first position in which the first and second cylinder head ports are in fluid communication with the areas of higher and lower pressure respectively, and a second position in which the first and second cylinder head ports are in fluid communication with the areas of lower and higher pressure respectively, so as to induce reciprocating movement of the piston within the cylinder; and (l) switch means operable to switch the position of the gas flow valve at or near the end of each stroke of the piston;

wherein:

(m) the cylinder sidewall, the piston side face, and the first and second piston sealing means define an annular space;

(n) the piston has a transverse passage extending between the piston faces, and a radial passage extending between the transverse passage and the annular space; and (o) the apparatus further comprises shuttle valve means retainingly disposed within the transverse passage, for enabling gas from whichever cylinder chamber is under lower pressure to flow through the transverse and radial passages into the annular space, while preventing the flow of gas from the cylinder chamber under higher pressure into the transverse passage.

BRIEF DESCRIPTION OF THE DRAWINGS

FIG. 4A is an elevational view of a rotary valve in accordance with a first embodiment.

FIG. 4B is a plan view of the rotary valve of FIG. 4A.

FIG. 4C is a cross-sectional view of the rotary valve of FIG. 4A.

FIG. 4D is a cross-section through the rotor of the rotary valve of FIG. 4A, configured in a first position such that the first chamber of the cylinder of the apparatus is in fluid communication with an area of higher pressure in a pressurized gas system, and the second cylinder chamber is in fluid communication with an area of lower pressure in the pressurized gas system.

FIG. 4E is a cross-section through the rotor of the rotary valve of FIG. 4A, configured in a second position such that the second cylinder chamber is in fluid communication with the area of higher pressure, and the first cylinder chamber is in fluid communication with the area of lower pressure.

FIG. 5A is an elevational view of a rotary valve in accordance with a second embodiment of the invention.

FIG. 5B is a plan view of the rotary valve of FIG. 5A.

FIG. 5C is a cross-sectional view of the rotary valve of FIG. 5A.

FIG. 5D is a cross-section through of the rotor of the rotary valve of FIG. 5A, configured in a first position such that the first chamber of the cylinder of the apparatus is in fluid communication with an area of higher pressure in a pressurized gas system, and the second cylinder chamber is in fluid communication with an area of lower pressure in the pressurized gas system.

FIG. 5E is a cross-section through of the rotor of the rotary valve of FIG. 5A, configured in a second position such that the second cylinder chamber is in fluid communication with the area of higher pressure, and the first cylinder chamber is in fluid communication with the area of lower pressure.

DETAILED DESCRIPTION OF THE PREFERRED EMBODIMENT

Figure 1A:
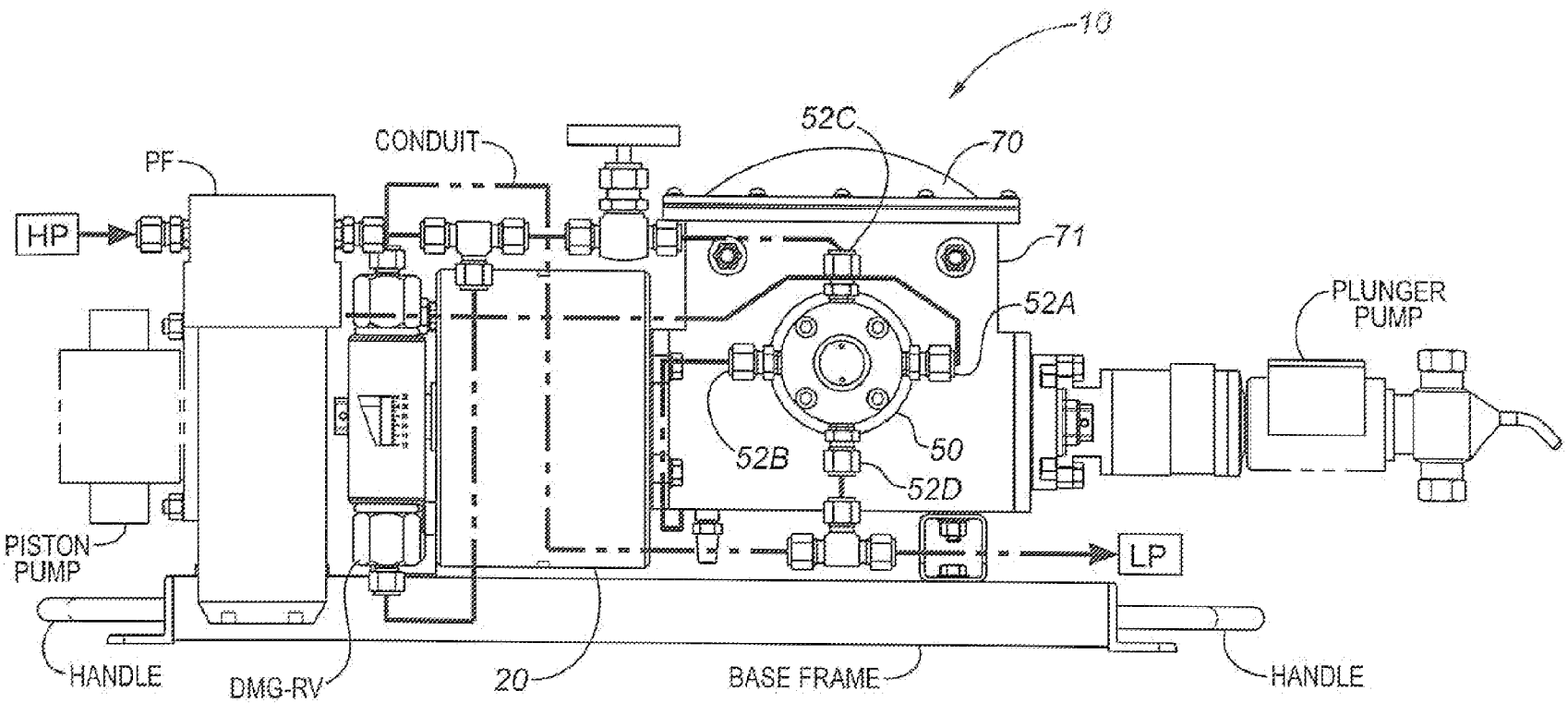
FIG. 1A is a side view of a pneumatic reciprocating motor apparatus in accordance with the preferred embodiment of the present invention, configured to power a pair of pumps (illustrated for exemplary purposes as a piston pump and a plunger pump).
Figure 1B:
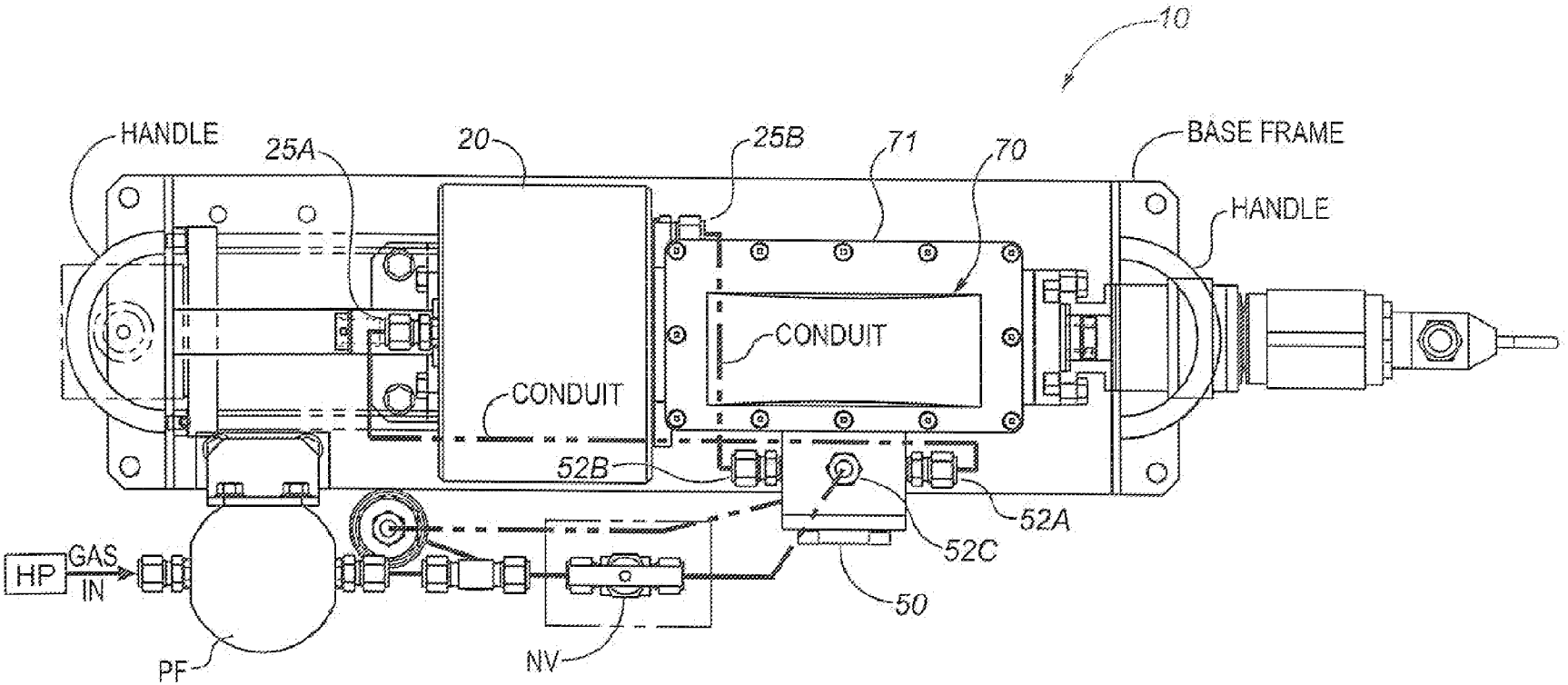
FIG. 1B is a plan view of the pneumatic reciprocating motor of FIG. 1A.

Referring in particular to FIGS. 1A, 1B, 2, and 3, the pneumatic motor of the present invention (generally designated by reference number 10), comprises a pneumatic cylinder 20 and a double-acting piston 30 that is reciprocatingly and coaxially movable within pneumatic cylinder 20. The pneumatic cylinder 20 has a cylindrical inner wall 22 and is capped at each end by cylinder heads 24A and 24B. The piston 30 has circular piston faces 32A and 32B and a circumferential side surface 34 extending between piston faces 32A and 32B. A piston rod 36, having ends 36A and 36B, is rigidly and coaxially fixed to piston 30, with rod ends 36A and 36B extending through rod openings 26A and 26B in cylinder heads 24A and 24B respectively. Piston rod seals 26C are provided in association with rod openings 26A and 26B such that piston rod 36 is reciprocatingly movable through rod openings 26A and 26B in substantially pressure-tight fashion. In the preferred embodiment, piston rod seals 26C are dynamic seals similar to the piston seals 38 described elsewhere in this specification.

Pneumatic cylinder 20 defines an annular cylinder chamber 28A bounded by cylinder wall 22, cylinder head 24A, and piston face 32A, and an annular cylinder chamber 28B bounded by cylinder wall 22, cylinder head 24B, and piston face 32B. The length and volume of cylinder chambers 28A and 28B varying according to the position of piston 30 within cylinder 20. For purposes to be explained further herein, cylinder head 24A has cylinder head gas port 25A in fluid communication with cylinder chamber 28A, and cylinder head 24B has cylinder head gas port 25B in fluid communication with cylinder chamber 28B.

Figure 3:
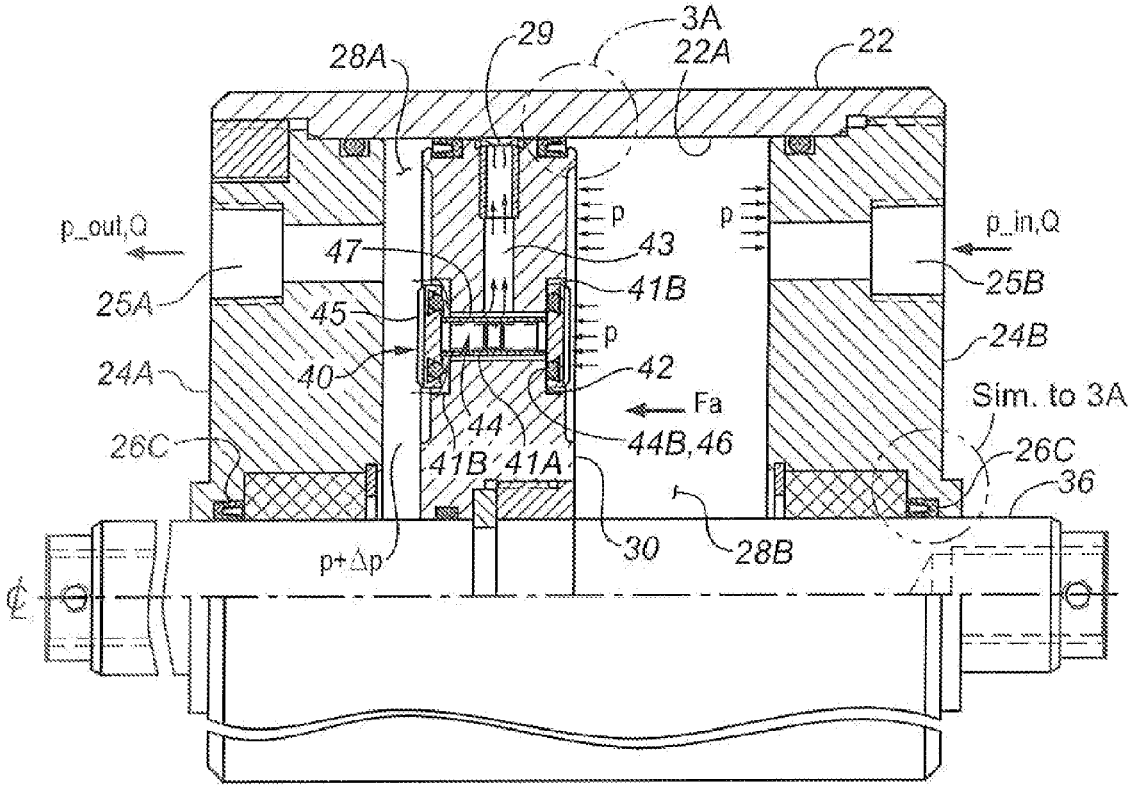
FIG. 3 is a partial section through the cylinder and piston of the apparatus, particularly illustrating the differential shuttle valve of the invention.
Figure 3A:
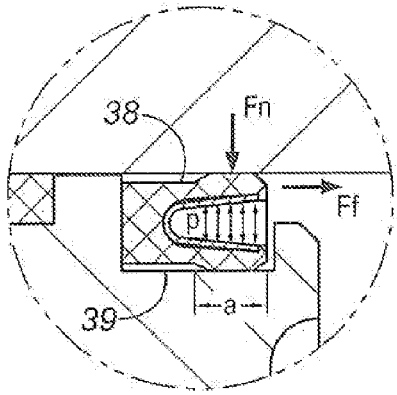
FIG. 3A is a cross-sectional detail of a spring-type circumferential seal as preferably used with the piston of the apparatus, conceptually illustrating the normal forces and friction forces associated with the seal.

As particularly illustrated in FIGS. 3 and 3A, piston 30 is provided with two circumferential piston seals 38, each disposed in a circumferential chase 39 formed into side surface 34 of piston 30 near one end of piston 30. Piston seals 38 are at all times sealingly engaged against cylinder wall 22, so as to substantially prevent leakage of gas from either of the cylinder chambers 28A and 28B. In the preferred embodiment, as shown in FIGS. 3 and 3A, piston seals 38 are dynamic seals that include a core element made from an elastic material and formed with a "horseshoe" cross-section, such that they need to be radially compressed for insertion into their respective chases 39. The elastic energy or spring force thus induced in the piston seals 38 biases them radially outward and into contact with cylinder wall 22. As conceptually illustrated in FIG. 3A, this outward biasing force manifests as a normal force $F_n$ acting against cylinder wall 22. The friction force $F_f$ required to overcome normal force $F_n$ (in order for piston 30 to move) is directly proportional to normal force $F_n$. Accordingly, piston seals 38 are ideally designed or selected so as to induce a normal force $F_n$ that is as low as possible in order to minimize friction force $F_f$, while being high enough to ensure a vapor-tight seal against cylinder wall 22.

Figure 2:
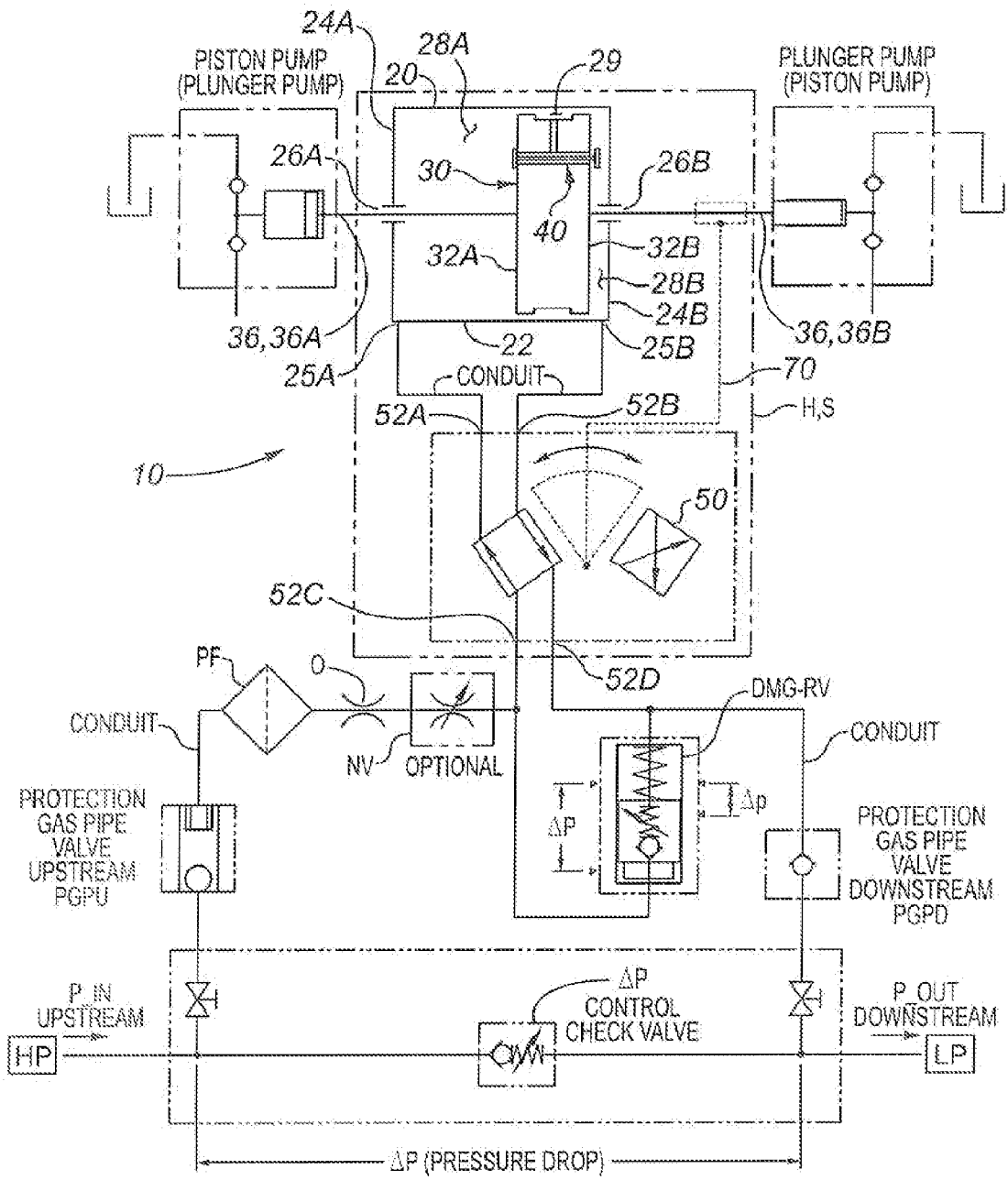
FIG. 2 is a schematic drawing of the pneumatic reciprocating motor in accordance with the preferred embodiment of the invention.

Referring to FIGS. 2 and 3, piston 30 incorporates a shuttle valve 40 whereby pressurized gas can be introduced into the annular space 29 radially bounded by piston 30 and cylinder 20, and longitudinally bounded by piston seals 38. A transverse passage 41 extends through piston 30 at a selected location, with said passage 41 configured to include a central bore 41A and a concentric and larger diameter recess 41B adjacent to each of piston faces 32A and 32B, such that an annular shoulder 42 is formed between central bore 41A and each recess 41B. A radial passage 43 extends through piston 30 between central bore 41A and annular space 29. Shuttle valve 40 includes a shuttle member 44 with cap members 45 at each end, with the clear distance between the cap members 45 being greater than the length of central bore 41A between recesses 41B. Each cap member has an outer face 45A and an inner face 45B and an annular groove 45C is formed in each inner face 45B for receiving an O-ring 46 or similar sealing member.

The cross-sectional geometry of shuttle member 44 is configured such that shuttle member 44 can slide freely within central bore 41A but with fairly close tolerances so that it slides substantially coaxially within central bore 41A, while at the same time defining at least one longitudinal channel between shuttle member 44 and the walls of central bore 41A. In one embodiment, this feature is provided by forming shuttle member 44 from initially round stock into which one or more longitudinal flattened surfaces are formed. This creates one or more longitudinal channels 47 which in cross section resemble a circular segment. This and alternative embodiments of the shuttle member 44 are illustrated in FIGS. 3B through 3E (described in further detail below).

As shown in FIG. 3, shuttle valve 40 is assembled with shuttle member 44 disposed within central bore 41A, and with each cap member 45 disposed within a corresponding recess 41B. Accordingly, each O-ring 46 directly faces and is substantially parallel to a corresponding shoulder 42. Because the length of shuttle member 44 is greater than the length of central bore 41A, one of cap members 45 will always be separated slightly away from their corresponding shoulders 42. When one cap member 45 is separated from its corresponding shoulder 42 (such as the lefthand cap member 45 in FIG. 3), a pathway is created whereby gas present in cylinder chamber 28A can pass around cap member 45, through longitudinal channel(s) 47, through radial passage 43, and into annular space 29. As may be seen from FIG. 3, if the righthand cap member 45 is being pressed against its corresponding shoulder 42, the corresponding O-ring 46 will seal the righthand cap member 45 against its corresponding shoulder 42, thus preventing any flow of gas between cylinder chamber 28B and the shuttle valve 40.

Figure 3B:
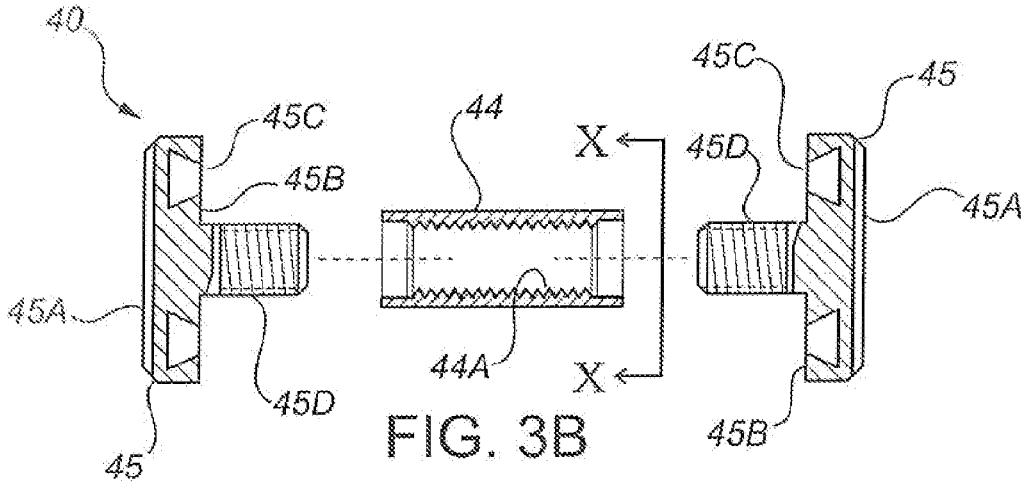
FIG. 3B is an exploded view of the differential shuttle valve of the invention, in accordance with the embodiment illustrated in FIG. 3.
Figure 3C:
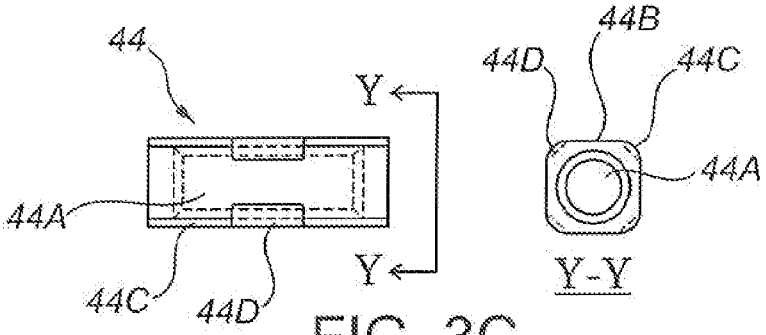
FIG. 3C is an elevational view (with cross-sectional detail) of the shuttle member of the differential shuttle valve shown in FIG. 3.

FIGS. 3B and 3C illustrate one alternative construction of the shuttle valve 40. As shown in FIG. 3B, each cap member 45 has a threaded stem 45D that is matingly engageable with threaded bore 44A of shuttle member 44. To assemble the shuttle valve 40, one cap member 45 is screwed into one end of shuttle member 44, and this subassembly is inserted into central bore 41A of piston 30. The other cap member 45 may then be screwed into the other end of shuttle member 44.

As shown in FIG. 3C, shuttle member 44 is made from round stock that has been milled flat on four sides 44B, leaving four longitudinal surfaces 44C which retain the radius of the round stock. The radius of the round stock is slightly less than the radius of central bore 41A, such that shuttle member 44 can slide freely within central bore 41A but without significant "play". When the shuttle valve 40 is installed in central bore 41A of piston 30, the space between the surface of central bore 41A and each flattened side surface 44B forms a longitudinal channel 47. Centrally-located portions of the longitudinal surfaces 44C of shuttle member 44 are milled to create recessed areas 44D that permit fluid communication between adjacent longitudinal channels 47. The length of the recessed areas 44D is such that at least a portion of the length will coincide with the opening from central bore 41A into radial passage 43 regardless of the position of shuttle valve 40 within central bore 41A. This arrangement ensures that gas flowing into the longitudinal channels 47 from cylinder chamber 28A or cylinder chamber 28B will pass through longitudinal channels 47 into radial passage 43 and thence into annular space 29.

Figure 3D:
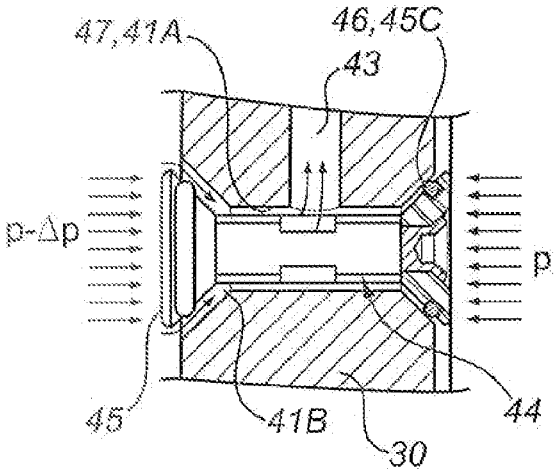
FIG. 3D illustrates an alternative embodiment of the differential shuttle valve, with frustoconical cap members.
Figure 3E:
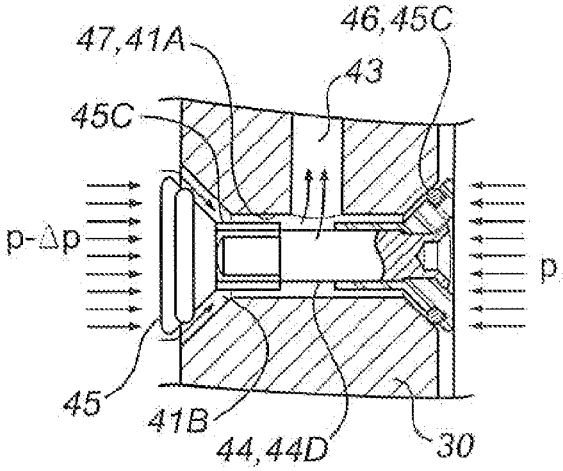
FIG. 3E illustrates a further alternative embodiment of the differential shuttle valve, with frustoconical cap members and an alternatively configured shuttle member.

FIG. 3D illustrates an alternative construction of shuttle valve 40 largely similar to that shown in FIGS. 3, 3B, and 3C except that cap members 45 are of frustoconical configuration and recesses 41B are correspondingly shaped. FIG. 3E illustrates an alternative construction of shuttle valve 40 having frustoconical cap members 45 as in FIG. 3D but with a differently-configured shuttle member 44. As conceptually indicated, the stems 45C of cap members 45 are internally threaded and mate with externally-threaded ends of shuttle member 44. The frustoconical cap members 45 are effectively self-centering within central bore 41A, so the diameter of stems 45C can be sufficiently smaller than that of central bore 41A so as to form a substantially longitudinal channel 47 therebetween. The diameter of shuttle member 44 is less than that of stems 45C, so as to form an annular recessed area 44D. Alternatively, stems 45C may be fabricated with flattened surfaces similar to the flattened side surface 44B of the shuttle member 44 in FIG. 3C, with corresponding longitudinal surfaces 44C, such that stems 45C can slide freely but without play within central bore 41A.

It can be readily seen that if the gas pressure in cylinder chamber 28B exceeds the gas pressure in cylinder chamber 28A, the shuttle valve assembly 40 will move to the left, into the position shown in FIG. 3, with gas free to flow from cylinder chamber 28A to annular space 29 as described above. If the pressure in cylinder chamber 28A is then made to exceed the gas pressure in cylinder chamber 28B, the shuttle valve assembly 40 will move to the right, sealing the lefthand cap member 45 against its corresponding shoulder 42 and preventing any flow of gas between cylinder chamber 28A and the shuttle valve 40, while at the same time allowing gas to flow from cylinder chamber 28B to annular space 29.

Other configurations of shuttle valve 40, functioning substantially as described above, may be devised without departing from the principles and scope of the present invention.

The pneumatic motor 10 also includes a multi-position gas valve 50 having valve ports 52A, 52B, 52C, and 52D. By means of suitable conduits, valve port 52A is in fluid communication with cylinder head port 25A and valve port 52B is in fluid communication with cylinder head port 25B. Valve port 52C is in fluid communication with an area HP in a pressurized gas system (such as a gas pipeline), and valve port 52D is in fluid communication with an area LP in the gas system, said area LP being at a pressure lower than area HP. Gas valve 50 is operable between:

- a first position in which valve ports 52A and 52C are in fluid communication, putting cylinder chamber 28A in fluid communication with area HP, while valve ports 52B and 52D are in fluid communication, putting cylinder chamber 28B in fluid communication with area LP; and
- a second position in which valve ports 52A and 52D are in fluid communication, putting cylinder chamber 28A in fluid communication with area LP, while valve ports 52B and 52C are in fluid communication, putting cylinder chamber 28B in fluid communication with area HP.

FIGS. 4A to 4E illustrate a multi-position gas valve 50 in accordance with a preferred embodiment of the present invention. As best seen in FIGS. 4D and 4E, the gas valve 50 in this embodiment is a rotary valve having a cylindrical interior cavity 54, with valve ports 52A, 52B, 52C, and 52D all in communication therewith. Cavity 54 is circumferentially bounded by cylindrical surface 53. A rotor 56 is coaxially rotatable within cavity 54 about rotational axis A, and is geometrically configured such that particular valve ports will be in fluid communication, via segmental sub-cavities 54A on either side of rotor 56, when the valve 50 is in the first and second positions, as described above. Rotor 56 is fixed to valve shaft 67 so as to be coaxially rotatable about rotational axis A. Rotor 56 has rotor ends 58 that engage cylindrical surface 55 as rotor 56 cycles between operational positions, in substantially vapor-tight fashion such that there is no leakage of gas between segmental sub-cavities 54A.

Preferably, the vapor-tight engagement of rotor ends 58 with cylindrical surface 55 is facilitated by use of a separate sealing means, an example of which is illustrated in FIGS. 4D and 4E. In the illustrated embodiment, a longitudinal slot 62 is formed in each rotor end 58, and a resilient biasing means 64 is disposed along the base of each slot 62. A selected pressure seal material 66 (such as, for instance, Teflon™ lamella) is then inserted into each slot 62, with the dimensions of the pressure seal 66 being such that it will project slightly beyond the face of rotor end 58 when not subject to compressive force urging it radially into slot 62. Thus, when rotor 58 is positioned within cavity 54, pressure seal 66 will at all times be in contact with cylindrical surface 55, with resilient biasing means 64 constantly urging pressure seal 66 radially outward against cylindrical surface 55.

In FIGS. 4D and 4E, rotor 56 is shown having straight or flat side portions, but this is not critical. The rotor 56 may have curvilinear or other geometric contours without substantively affecting the functioning of valve 50, so long as the stated operational interrelation of valve ports 52A, 52B, 52C, and 52D is maintained when valve 50 is in the first and second operational positions.

Figure 7:
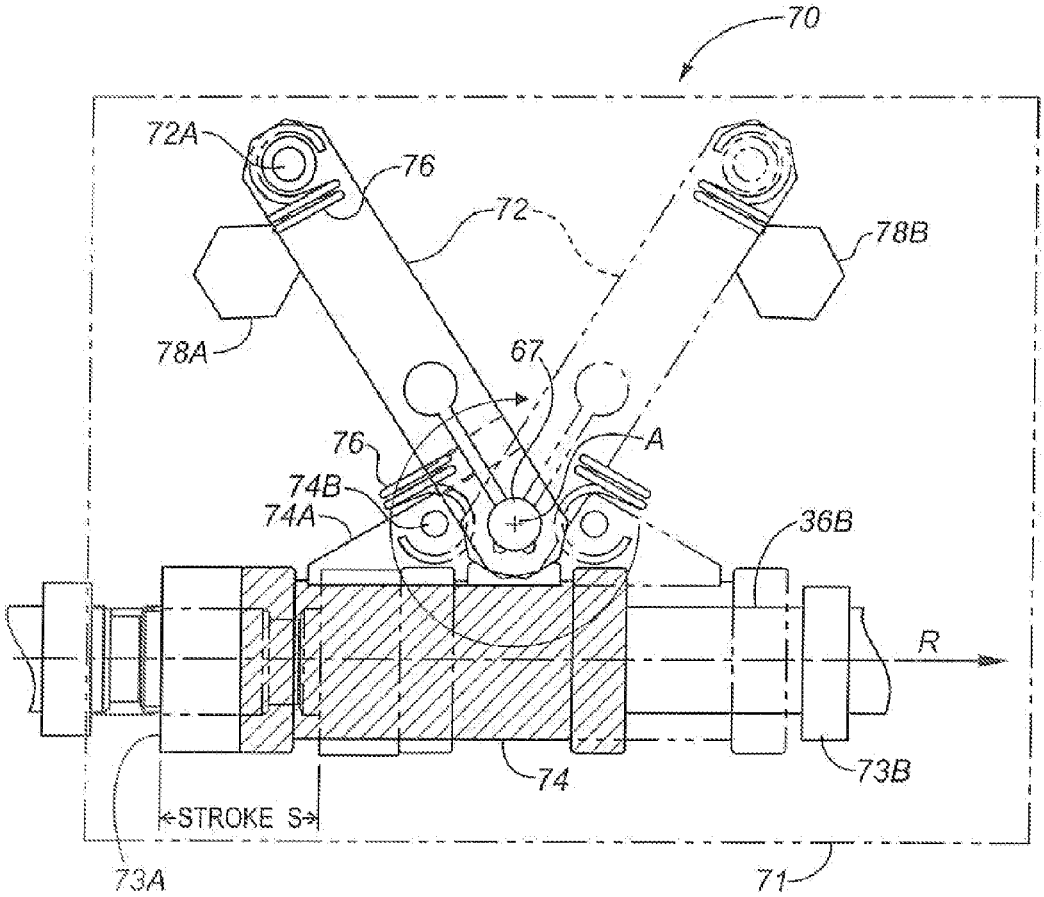
FIG. 7 is an elevational view of the switch mechanism of the rotary valve in accordance with a preferred embodiment of the invention.

Gas valve 50 is actuated between its first and second operational positions by means of a switch mechanism 70 which cycles the valve 50 at the end of each stroke of piston 30 and piston rod 36. It will be readily apparent to persons skilled in the art of the invention that a variety of mechanisms could be devised to carry out the function of switch mechanism 70 in accordance with the operational mode described above. FIG. 7 illustrates one example of such a mechanism, as used in a preferred embodiment of the invention. Switch mechanism 70 is disposed within switch housing 71. A sleeve 74 is slidingly disposed around the portion of piston rod 36B extending from cylinder 20. Piston rod 36B is reciprocatingly movable relative to switch housing 71 as piston 30 reciprocates within cylinder 20. Suitable collars 73A and 73B are positioned at a desired spacing on either side of the sleeve 74 so as to limit the range of sliding movement of sleeve 74 on piston rod 36B. A bracket 74A fixed to sleeve 74 has a spring-retaining pin 74B for receiving the first end of a tension spring 76. A lever arm 72 is mounted at one end to valve shaft 67, which projects into switch housing 71. The other end of lever arm 72 has a spring-retaining pin 72A which receives the second end of a tension spring 76 (shown in discontinuous fashion in FIG. 7 for purposes of clarity) Lever arm bumpers 78A and 78B are mounted to switch housing 71 to limit the travel of lever arm 72. Lever arm 72 is offset from piston rod 36B so as not to impede its reciprocating movement.

The operation of switch mechanism 70 may be understood from FIG. 7, in which sleeve 74 (shown cross-hatched for clarity) is at its leftmost limit of travel relative to piston rod 36B. For purposes of illustration, valve 50 may be considered to be in its first position when the switch mechanism is as shown in solid outline in FIG. 7. As piston rod 36B moves to the right (indicated by arrow R in FIG. 7), sleeve 74 will be pushed to the right as well by collar 73A. The rightward movement of sleeve 74 causes tension spring 76 to stretch, but this initially has no effect on lever arm 72, which remains in position against the left bumper 78A. However, as the center of spring-retaining pin 74B moves rightward past rotational axis A of valve shaft 67, the tensile force in tension spring 76, acting downward and to the right against spring-retaining pin 72A, applies a clockwise moment on lever arm 72, around rotational axis A. The magnitude of this moment increases as the rightward movement of sleeve 74 progresses, until it overcomes the resistant moment acting on valve shaft 67 (e.g., due to friction forces within the valve 50). At that point, lever arm 72 will swing clockwise to the position shown in phantom outline. Since lever arm 72 is fixed to valve shaft 67, this has the effect of switching valve 50 from its first position to its second position. Piston rod 36B will reach the end of its rightward stroke soon after this happens; at this point, sleeve 74 will be abutting collar 73B. Piston rod 36B will then begin its leftward stroke, ultimately causing lever arm 72 will swing counterclockwise, thus switching valve 50 from the second position back to the first position.

The positions of collars 73A and 73B relative to piston rod 36B may be adjusted so as to regulate the lag between the swing of lever arm 72 and the end of the piston rod stroke.

The operation of the pneumatic motor of the present invention may now be easily understood having reference to FIGS. 2, 3, 4D, and 4E in particular. With gas valve 50 in the first position, higher-pressure gas from area HP flows into cylinder chamber 28A while lower-pressure gas from area LP flows into cylinder chamber 28B. The pressure differential between the two chambers causes piston 30 to move to the right, into the position shown in FIG. 2. This causes piston rod 36 to move in a rightward power stroke. At the same time, the pressure differential causes differential valve 40 to move to the right such that the lefthand cap member 45 (of shuttle valve 40) and its associated O-ring 46 are urged against their corresponding shoulder 42, while the righthand cap member 45 and its associated O-ring 46 are moved away from their corresponding shoulder 42. In this configuration, gas is prevented from escaping from cylinder chamber 28A into central bore 41A of piston 30, while gas is free to flow from cylinder chamber 28B into annular space 29, thus eliminating or greatly reducing the pressure differential across the piston seals 38.

As piston 30 reaches or nears the end of its rightward power stroke, switching mechanism 70 cycles gas valve 50 to the second position. Now, higher-pressure gas from area HP flows into cylinder chamber 28B while lower-pressure gas from area LP flows into cylinder chamber 28A. The pressure differential between the two chambers causes piston 30 to move to the left, into the position shown in FIG. 3. This causes piston rod 36 to move in a lefttward power stroke. At the same time, the pressure differential causes differential valve 40 to move to the left such that the righthand cap member 45 and its associated O-ring 46 are urged against their corresponding shoulder 42, while the lefthand cap member 45 and its associated O-ring 46 are moved away from their corresponding shoulder 42. In this configuration, gas is prevented from escaping from cylinder chamber 28B into central bore 41A of piston 30, while gas is free to flow from cylinder chamber 28A into annular space 29, thus once again eliminating or greatly reducing the pressure differential across the piston seals 38. As piston 30 reaches or nears the end of its leftward power stroke, switching mechanism 70 cycles gas valve 50 back to the first position, and the alternating cycles continue as long as valve ports 52C and 52D remain in fluid communication with areas HP and LP respectively in a pressurized gas system.

The foregoing discussion has been in the context of a pneumatic motor using the rotary valve illustrated in FIGS. 4A to 4D. However, various other forms of gas valve 50 may be used without departing from the principles and scope of the present invention. FIGS. 5A to 5E illustrate a second embodiment of gas valve 50, which may be alternatively described as a planar valve. The valve body has valve ports 52A, 52B, 52C, and 52D as previously described in connection with the valve in FIGS. 4A to 4D. These ports are in fluid communication, respectively, with internal horizontal passages 55A, 55B, 55C, and 55D, which terminate at a common planar surface 51. As best seen in FIG. 5C, a valve disc 57, preferably made of Teflon™ (or an alternative material with good sealing and abrasion-resistance characteristics) is co-rotatably fixed to valve shaft 67. Valve disc 57 interfaces tightly against planar surface 51 as shown, and is retained by retainer plate 57D. Valve disc 57 has arcuate channels 57A and 57B, the configuration of which can best be seen in FIGS. 5D and 5E. Arcuate channels 57A and 57B, which extend only partly through the thickness of valve disc 57, are configured so as to align with horizontal passages 55A, 55B, 55C, and 55D, as schematically shown in FIGS. 5D and 5E, which show the valve 50 in its first and second positions respectively.

In the first position (FIG. 5D), higher-pressure gas flows through port 52C, horizontal passage 55C, and channel 57A into horizontal passage 55A, and thence to cylinder chamber 28A. At the same time, spent gas from cylinder chamber 28B flows from horizontal passage 55B into channel 57B, and thence through horizontal passage 55D and port 52D to the area of lower pressure. In the second position (FIG. 5E), higher-pressure gas flows through port 52C, horizontal passage 55C, and channel 57A into horizontal passage 55B, and thence to cylinder chamber 28B, while spent gas from cylinder chamber 28A flows from horizontal passage 55A into channel 57B, and thence through horizontal passage 55D and port 52D to the area of lower pressure.

Figure 5F:
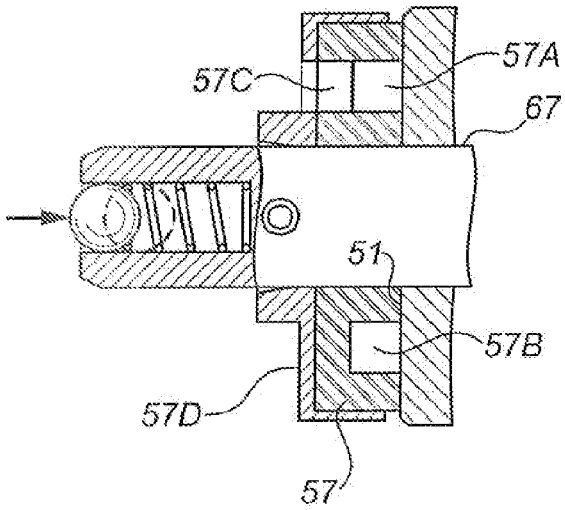
FIG. 5F is a sectional detail of the resistance adjustment mechanism of the rotary valve shown in FIGS. 5B and 5C.

As shown in FIG. 5C, gas valve 50 may have a pressure chamber 59. In this configuration, and as may been seen in FIGS. 5C to 5E, valve disc 57 has an auxiliary passage 55C centered within channel 57A and passing through the full thickness of valve disc 57. Retainer plate 57D has a corresponding opening such that gas can flow from channel 57A into pressure chamber 59. This has beneficial effect of pressurizing pressure chamber 59 so as to assist in maintaining valve disc 57 in close sealing contact against planar surface 51. As illustrated in FIGS. 5B, 5C, and 5F, gas valve 50 in this embodiment may have a spring-loaded resistance-adjustment mechanism with adjustment screw 58, for adjusting the interfacial pressure between the valve disc 57 and planar surface 51. This in turn adjusts the resisting moment acting on valve shaft 67, thus providing additional means of controlling or fine-tuning the operation of switching means 70.

Figure 6F:
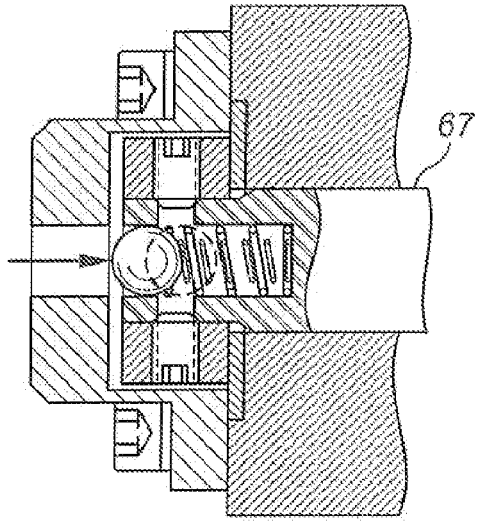
FIG. 6F is a sectional detail of the resistance adjustment mechanism of the rotary valve shown in FIGS. 6B and 6C.
Figure 6B:
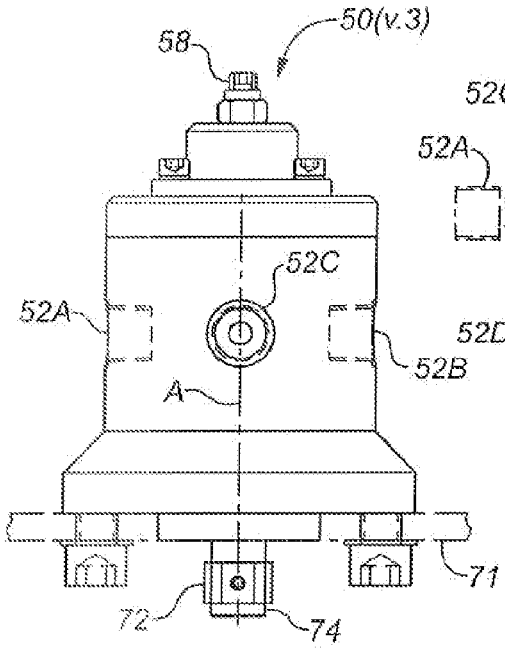
FIG. 6B is a plan view of the rotary valve of FIG. 6A.
Figure 6D:
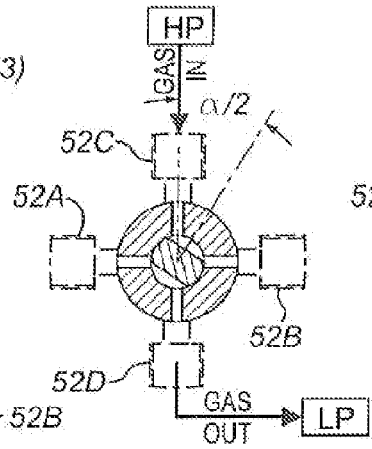
FIG. 6D is a cross-section through of the rotor of the rotary valve of FIG. 6A, configured in a first position such that the first chamber of the cylinder of the apparatus is in fluid communication with an area of higher pressure in a pressurized gas system, and the second cylinder chamber is in fluid communication with an area of lower pressure in the pressurized gas system.
Figure 6E:
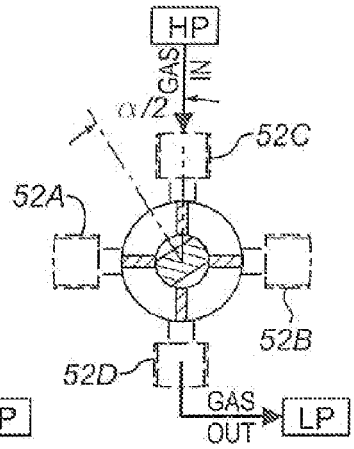
FIG. 6E is a cross-section through of the rotor of the rotary valve of FIG. 6A, configured in a second position such that the second cylinder chamber is in fluid communication with the area of higher pressure, and the first cylinder chamber is in fluid communication with the area of lower pressure.
Figure 6A:
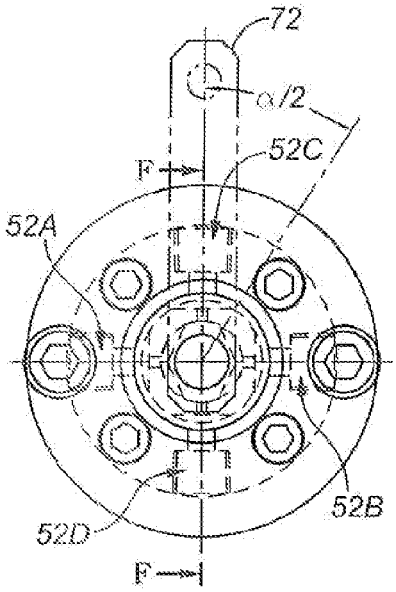
FIG. 6A is an elevational view of a rotary valve in accordance with a third embodiment of the invention.
Figure 6C:
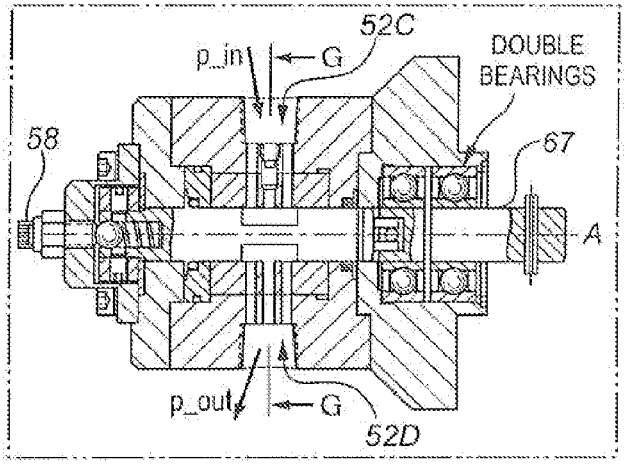
FIG. 6C is a cross-sectional view of the rotary valve of FIG. 6A.

FIGS. 6A to 6E illustrate a third embodiment of gas valve 50, and FIG. 6F illustrates a spring-loaded resistance-adjustment mechanism. Having regard to the preceding explanations of the first and second gas valve embodiments, the configuration and operation of the valve in FIGS. 6A to 6E will be readily comprehended by persons skilled in the art, without need of detailed discussion.

Figure 8A:
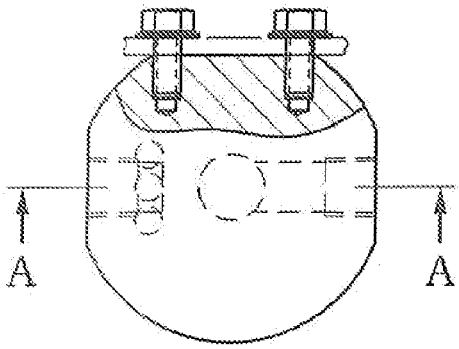
FIG. 8A is an elevational view of a pneumatic filter in accordance with a preferred embodiment of the invention.
Figure 8A:
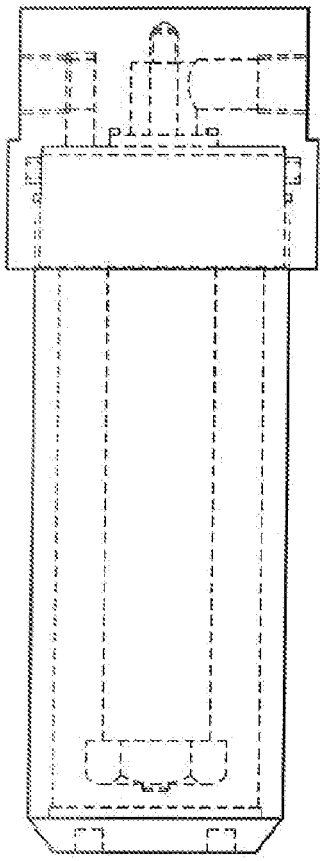
Figure 8B:
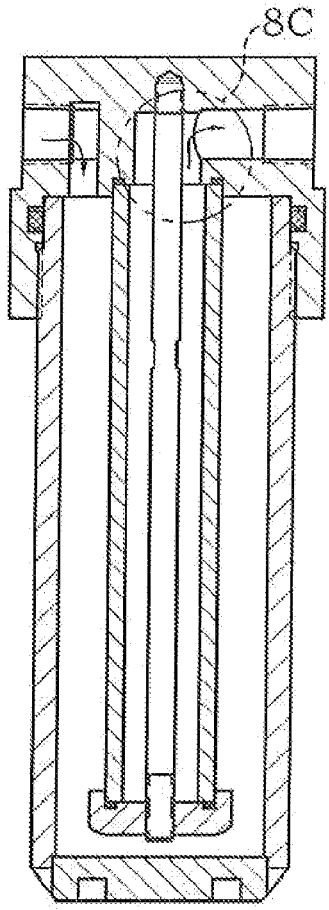
FIG. 8B is a cross-sectional view through the pneumatic filter shown in FIG. 8A.
Figure 8C:
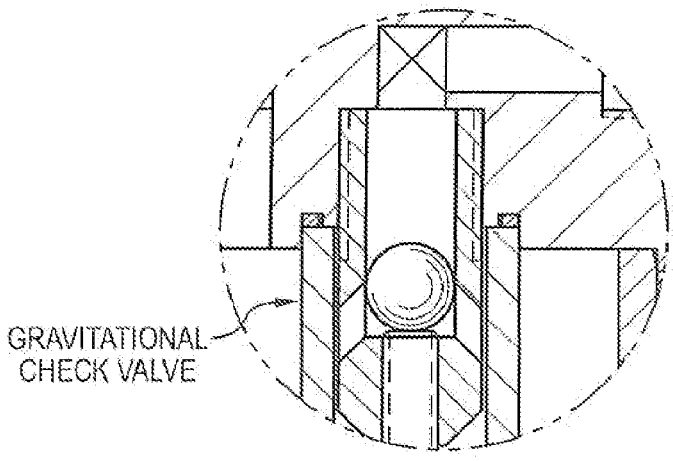
FIG. 8C is a detail of an optional gravitational check valve of the pneumatic filter.
Figure 9A:
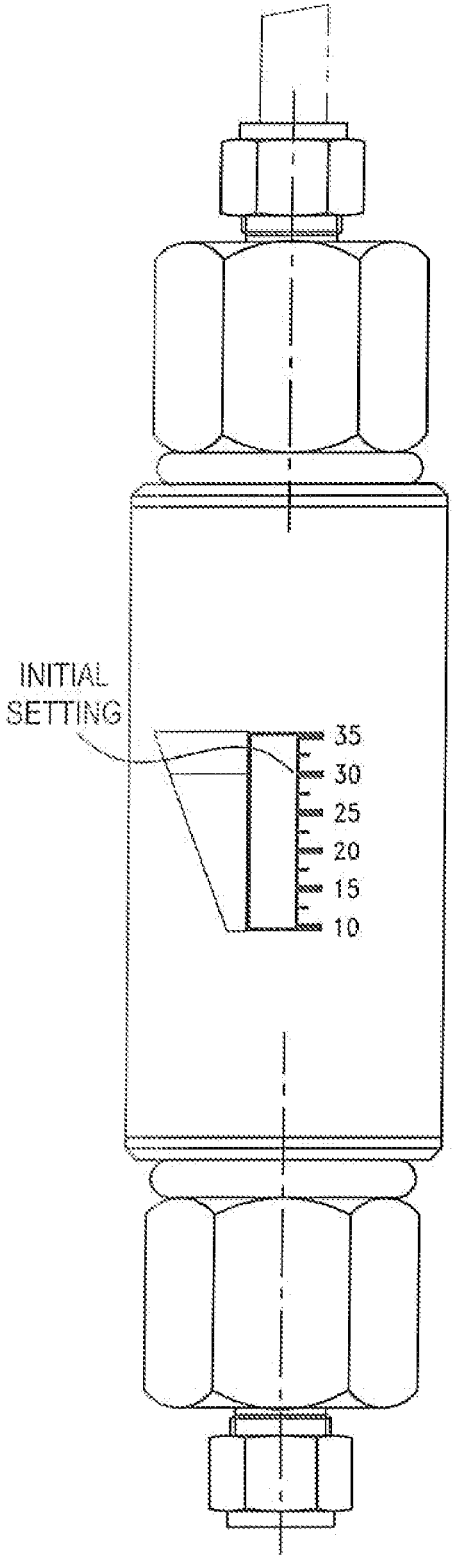
FIG. 9A is an elevational view of a differential magnetic gauge in accordance with a preferred embodiment of the invention.
Figure 9B:
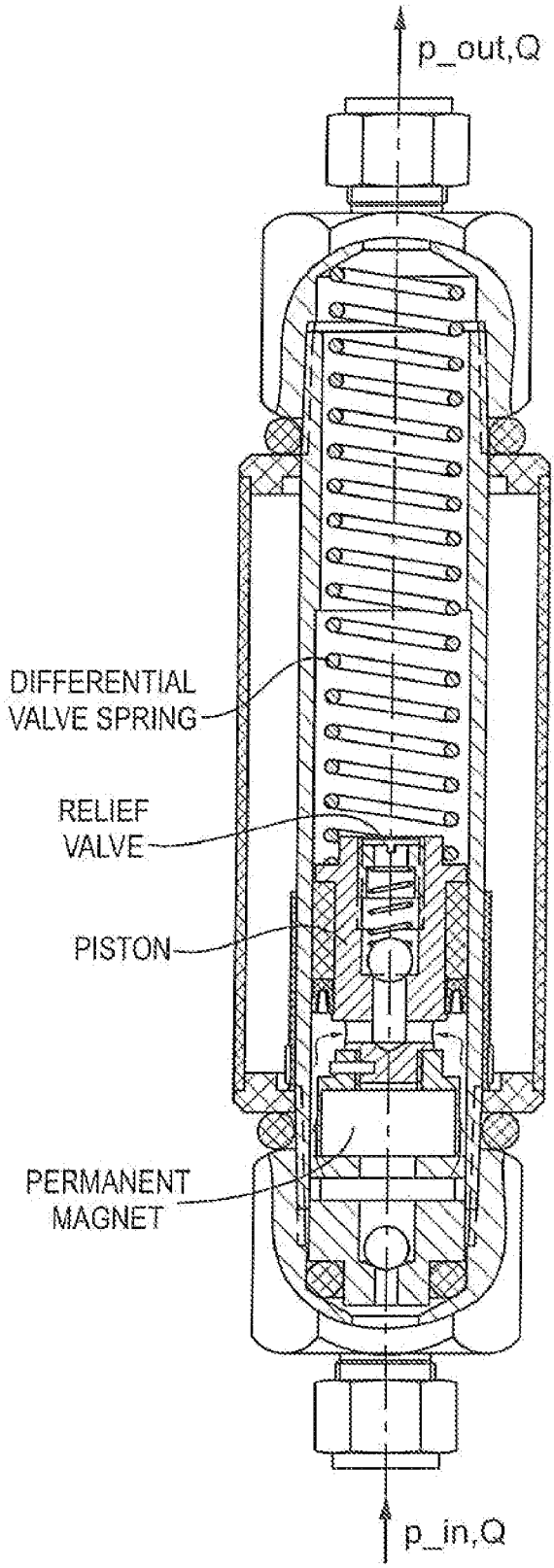
FIG. 9B is a cross-sectional view of the gauge of FIG. 9A.

In preferred embodiments, the pneumatic motor also incorporates a pneumatic filter as illustrated in FIGS. 1A, 1B, 8A, and 8B, to remove impurities from gas flowing into the motor from the area of higher pressure. Even more preferably, the pneumatic filter features a gravitational check valve as shown in FIG. 8C. Also in the preferred embodiment, the pneumatic motor incorporates a combined relief valve and differential magnetic gauge, as illustrated in FIGS. 1A, 1B, 9A and 9B, for indicating the pressure differential between the higher and lower pressure areas, and for maintaining the pressure differential within desired limits.

Figure 10:
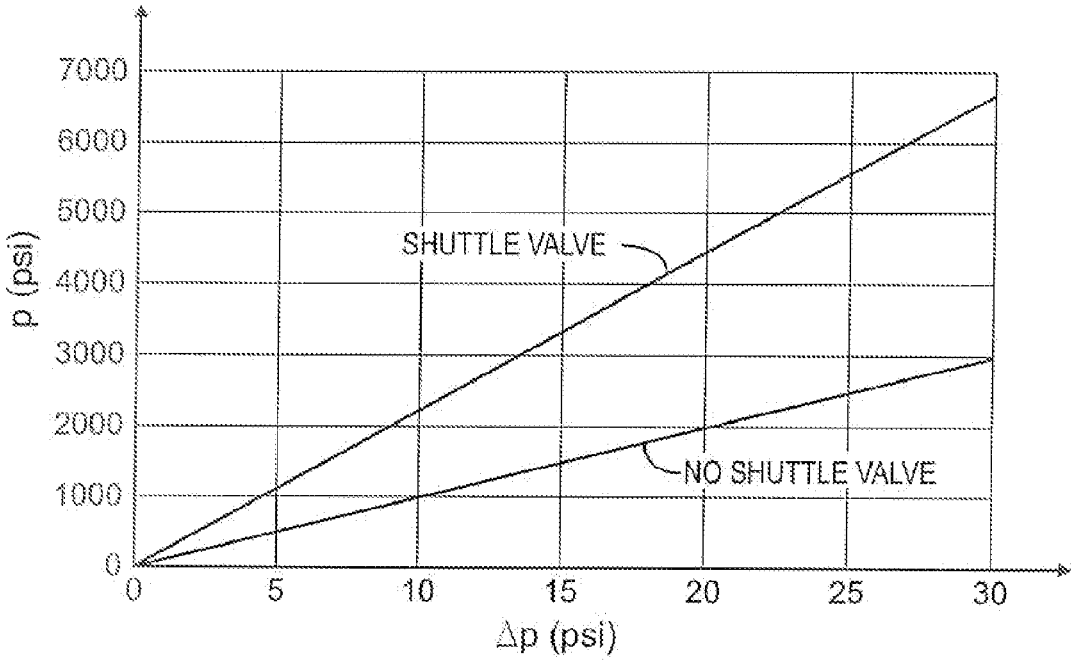
FIG. 10 is a graph plotting measured output pressures for a plunger pump driven by a pneumatic reciprocating motor in accordance with an embodiment of the present invention, with and without the differential shuttle valve.

FIG. 10 provides a graphic illustration of the beneficial effectiveness of the differential shuttle valve of the present invention. Tests were performed using two pneumatic reciprocating motors, in accordance with one embodiment of the invention. The two test motors were essentially identical except that one had a differential shuttle valve and the other did not. The piston of each test motor had a diameter of six inches and a stroke of three inches. Each test motor was used to drive a plunger pump under conditions where the input gas pressure to the motor was 100 psi, and the outlet gas pressure from the motor was varied from 90, 80, and 70 psi (i.e., corresponding to differential pressures of 10, 20, and 30 psi.). The maximum oil pressure produced by the plunger pump was read on a pressure gauge having a capacity of 7,000 psi. The results of these tests, plotted on FIG. 10, indicate a large increase in the pump's output pressure when driven by the motor having the differential shuttle valve.

It will be readily seen by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. Reciprocating pneumatic drive apparatus for use in association with a compressed gas system having an area of higher pressure and an area of lower pressure, said apparatus comprising:

(a) a cylinder having a cylindrical sidewall extending between a pair of cylinder heads, each of which has a piston rod opening;

(b) a piston having first and second piston faces plus first and second piston rods, each projecting from a corresponding piston face, said piston being reciprocatingly slidable within the cylinder, with each piston rod being sealingly slidable through the piston rod opening of a corresponding one of the cylinder heads, said piston demarcating first and second variable-length cylinder chambers, one at each end of the cylinder;

(c) a pair of spaced-apart piston seals disposed circumferentially around the piston, for sealing between the piston and the sidewall, said piston seals defining the ends of an annular space;

(d) valve means operable between a first position in which the first and second cylinder chambers are in fluid communication with the areas of higher and lower pressure respectively, and a second position in which the first and second cylinder chambers are in fluid communication with the areas of lower and higher pressure respectively, so as to induce reciprocating movement of the piston within the cylinder; and (e) switch means operable to switch the position of the gas flow valve at or near the end of each stroke of the piston;

wherein:

(f) the piston has a transverse passage extending between the piston faces, and a radial passage extending between the transverse passage and the annular space; and (g) the apparatus further comprises shuttle valve means retainingly disposed within the transverse passage, for enabling gas from whichever cylinder chamber is under lower pressure to flow through the transverse and radial passages into the annular space, while preventing the flow of gas from the cylinder chamber under higher pressure into the transverse passage.

2. The drive apparatus of claim 1 wherein the gas flow valve means is a rotary valve having:

(a) a first valve port in fluid communication with the first cylinder chamber;

(b) a second valve port in fluid communication with the second cylinder chamber;

(c) a third valve port in fluid communication with the area of higher pressure;

(d) a fourth valve port in fluid communication with the area of lower pressure;

(e) a cylindrical cavity in fluid communication with each of said valve ports; and (f) a rotor co-rotatably fixed to a valve shaft, said rotor being sealingly and rotatably disposed within said cavity, so as to partition said cavity into first and second sub-cavities, the orientation of which is variable with the position of the rotor;

and wherein said valve shaft may be rotated to cycle said rotor between:

(g) a first position in which said first and third valve ports are in fluid communication with the first sub-cavity, and said second and fourth valve ports are in fluid communication with the second sub-cavity; and (h) a second position in which said first and fourth valve ports are in fluid communication with the first sub-cavity, and said second and third valve ports are in fluid communication with the second sub-cavity.

3. The drive apparatus of claim 2 wherein the switch means comprises:

(a) a switch housing, positioned such that the valve shaft extends into but not through the housing, and such that the first piston rod extends through the housing, with the axes of the valve shaft and the first piston rod being substantially perpendicular to each other but not intersecting;

(b) a sleeve slidably disposed around the portion of the first piston rod within the switch housing, said sleeve having a spring bracket;

(c) a pair of collars fixed to the first piston rod, said collars being positioned one on each side of said sleeve, with the distance between the collars being a selected distance greater than the length of the sleeve;

(d) a lever arm having a first end and a second end, said first end being mounted to the valve shaft within the switch housing;

(e) a tension spring having a first end connected to the spring bracket and a second end connected to the second end of the lever arm; and (f) a pair of spaced-apart lever arm bumpers mounted to the switch housing, said bumpers being disposed on either side of the lever arm so as to be alternatingly engaged by the lever arm as the rotary valve cycles between its first and second positions.

4. The drive apparatus of claim 3 wherein the collars are releasably fixed to the first piston rod, to enable adjustment of the distance between the collars.

5. The drive apparatus of claim 1 wherein the gas flow valve means is a valve comprising a valve body with first, second, third, and fourth internal passages terminating at a common planar terminal surface, and having:

(a) a first valve port in fluid communication with the first cylinder chamber and with said first internal passage;

(b) a second valve port in fluid communication with the second cylinder chamber and with said second internal passage;

(c) a third valve port in fluid communication with the area of higher pressure and with said third internal passage;

(d) a fourth valve port in fluid communication with the area of lower pressure and with said fourth internal passage;

(e) a valve disc co-rotatably fixed to a valve shaft and having first and second valve disc faces, wherein:

e.1 the first valve disc face abuts said planar terminal surface, while being sealingly and rotatably movable relative thereto;

e.2 first and second arcuate channels are formed into the second valve disc face and extend only partially through the thickness of the valve disc; and (f) a retainer plate against which the second valve disc face abuts, while being sealingly and rotatably movable relative thereto;

and wherein said valve shaft may be rotated to cycle said valve between:

(g) a first position in which said first and third valve ports are in fluid communication with the first arcuate channel, and said second and fourth valve ports are in fluid communication with the second arcuate channel; and (h) a second position in which said first and fourth valve ports are in fluid communication with the first arcuate channel, and said second and third valve ports are in fluid communication with the second arcuate channel.

6. The drive apparatus of claim 5 wherein:

(a) the valve disc has an auxiliary passage aligned with the first arcuate channel and extending through the thickness of the valve disc;

(b) the valve body defines a pressure chamber adjacent to the retainer plate; and (c) the retainer plate has an opening to allow gas to flow from the first arcuate channel into the pressure chamber.

7. The drive apparatus of claim 6, further comprising resistance-adjustment means, for adjusting the interfacial pressure between the first valve disc surface and the planar terminal surface.

8. The drive apparatus of claim 7 wherein the resistance-adjustment means comprises a compression spring retained within the valve body so as to exert force against the retainer plate when the spring is compressed, plus an adjustment screw for varying the spring compression, said adjustment screw being accessible from outside the valve body.

9. The drive apparatus of claim 1 wherein:

(a) the shuttle valve means comprises an elongate main shuttle member extending with a cap member at each end, each cap member having an annular inner face with sealing means engageable with a sealing surface associated with one of the piston faces, with the distance between the inner faces of the cap members being a selected distance greater than the distance between said sealing surfaces; and (b) the main shuttle member is configured so as to be slidable substantially coaxially within the transverse passage while permitting the passage of gas from either cylinder chamber into the radial passage.

10. The drive apparatus of claim 9 wherein at least one of the sealing surfaces coincides with the corresponding piston face.

11. The drive apparatus of claim 9 wherein at least one of the sealing surfaces is a shoulder formed in a recess in the corresponding piston face.

12. The drive apparatus of claim 9 wherein the annular inner face of at least one of the cap members is substantially planar.

13. The drive apparatus of claim 9 wherein the annular inner face of at least one of the cap members and its corresponding sealing surface are substantially frustoconical.

14. The drive apparatus of claim 9 wherein the main shuttle body is an internally-threaded sleeve, and at least one of the cap members has a threaded shaft engageable with the internal threads of the main shuttle body.

15. The drive apparatus of claim 9 wherein the main shuttle body is an externally-threaded shaft, and at least one of the cap members has a threaded sleeve engageable with the external threads of the main shuttle body.

16. The drive apparatus of claim 1, further comprising a pneumatic filter for removing impurities from gas flowing to the valve means from the area of higher pressure.

17. The drive apparatus of claim 16 wherein the pneumatic filter incorporates a gravitational check valve.

18. The drive apparatus of claim 1, further comprising a combined relief valve and differential magnetic gauge.

19. Reciprocating pneumatic drive apparatus for use in association with a compressed gas system having an area of higher pressure and an area of lower pressure, said apparatus comprising:

(a) a cylinder having a cylindrical sidewall and first and second cylinder heads, each cylinder head having a piston rod opening;

(b) a piston reciprocatingly disposed within the cylinder, said piston having first and second piston faces, and having a circumferential side face extending between said first and second piston faces;

(c) a first cylinder chamber defined by said sidewall, first cylinder head, and first piston face, the size of said first cylinder chamber varying according to the position of the piston within the cylinder;

(d) a second cylinder chamber defined by said sidewall, second cylinder head, and second piston face;

(e) a first piston rod rigidly fixed to the piston and extending from the first piston face, and being reciprocatingly and sealingly movable through the piston rod opening of the first cylinder head;

(f) a second piston rod rigidly fixed to the piston and extending from the second piston face, and being reciprocatingly and sealingly movable through the piston rod opening of the second cylinder head;

(g) first piston sealing means, for sealing between the sidewall and the side face of the piston, adjacent to the first piston face;

(h) second piston sealing means, for sealing between the sidewall and the side face of the piston, adjacent to the second piston face;

(i) first cylinder head port, in fluid communication with the first cylinder chamber;

(j) second cylinder head port, in fluid communication with the second cylinder chamber;

(k) a gas flow control valve alternatingly operable between a first position in which the first and second cylinder head ports are in fluid communication with the areas of higher and lower pressure respectively, and a second position in which the first and second cylinder head ports are in fluid communication with the areas of lower and higher pressure respectively, so as to induce reciprocating movement of the piston within the cylinder; and (l) switch means operable to switch the position of the gas flow valve at or near the end of each stroke of the piston;

wherein:

(m) the cylinder sidewall, the piston side face, and the first and second piston sealing means define an annular space;

(n) the piston has a transverse passage extending between the piston faces, and a radial passage extending between the transverse passage and the annular space; and (o) the apparatus further comprises shuttle valve means retainingly disposed within the transverse passage, for enabling gas from whichever cylinder chamber is under lower pressure to flow through the transverse and radial passages into the annular space, while preventing the flow of gas from the cylinder chamber under higher pressure into the transverse passage.

20. The drive apparatus of claim 19 wherein each piston sealing means is a dynamic seal having an elastic core of U-shaped cross-section, each said seal being disposable within a circumferential chase formed in the side face of the piston in association with radial compression of the elastic core, with a portion of the seal protruding from the circumferential chase to sealingly engage the side wall of the cylinder.

* * * * *